US006394503B1

(12) United States Patent
DeFosse et al.

(10) Patent No.: US 6,394,503 B1
(45) Date of Patent: May 28, 2002

(54) SYSTEM FOR SECURING TUBING

(75) Inventors: Stephen Francis DeFosse, Lexington; Curtis Ray Droege, Richmond, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/534,435

(22) Filed: Mar. 23, 2000

(51) Int. Cl.[7] ..... B41J 2/175
(52) U.S. Cl. ..... 285/136.1; 347/85
(58) Field of Search ..... 347/85, 86; 285/238, 285/239, 154.1, 154.2, 136.1, 139.1, 140.1

(56) References Cited

U.S. PATENT DOCUMENTS

| | | | | |
|---|---|---|---|---|
| 913,024 | A | 2/1909 | Meacham | |
| 1,594,225 | A | 7/1926 | Thomas, Jr. | |
| 2,461,357 | A | 2/1949 | Broido et al. | |
| RE23,720 | E | * 10/1953 | Gillespie | 285/154.1 |
| 3,082,023 | A | * 3/1963 | Rudolph et al. | 285/154.1 |
| 3,112,938 | A | 12/1963 | Karlin | |
| 3,129,020 | A | * 4/1964 | Bujnowski | 285/238 X |
| 3,643,987 | A | 2/1972 | DuPont | |
| 3,976,314 | A | 8/1976 | Graham | |
| 4,063,760 | A | 12/1977 | Moreiras | |
| 4,304,957 | A | 12/1981 | Slater et al. | |
| 4,330,010 | A | 5/1982 | Drescher et al. | |
| 4,366,343 | A | 12/1982 | Slater et al. | |
| 5,217,384 | A | 6/1993 | Merten et al. | |
| 5,474,336 | A | 12/1995 | Hoff et al. | |
| 5,692,783 | A | * 12/1997 | Watanabe et al. | 285/140.1 X |
| 5,751,319 | A | 5/1998 | Robertson et al. | |
| 5,796,419 | A | 8/1998 | Clark et al. | |
| 5,874,976 | A | 2/1999 | Katon et al. | |
| 5,912,687 | A | * 6/1999 | Cowger et al. | 347/85 |
| 5,951,059 | A | * 9/1999 | Kitamura | 285/140.1 |
| 6,145,967 | A | * 11/2000 | Langford et al. | 347/85 |

FOREIGN PATENT DOCUMENTS

| | | | | |
|---|---|---|---|---|
| JP | 6015834 | * 6/1994 | | 347/85 |

* cited by examiner

*Primary Examiner*—Lynne H. Browne
*Assistant Examiner*—David E. Bochna
(74) *Attorney, Agent, or Firm*—D. Brent Lambert; Gregory J. Kirsch

(57) ABSTRACT

The present invention relates to a system and a method for securing tubing which includes a reservoir, preferably being a printer cartridge, having a rigid wall with interior and exterior surfaces, a rigid restraining member for a tube, and the restraining member further having a passage therethrough. In one embodiment, the invention includes at least one locking lever with top and bottom ends, the locking lever having at least one notch proximate to the top end and the bottom end is pivotably attached to the interior surface of the reservoir wall, and the restraining member is alternately attached to the top end of the locking lever. In another embodiment, the locking lever is rigidly attached to the interior surface of the reservoir and the restraining member is alternately attached to the reservoir. In a further embodiment, the restraining member is attached to interior of the reservoir wall by at least two locking arms. The reservoir wall has an opening and a tube assembly comprised of the rigid restraining member and the flexible tubing fits into the opening. The tube assembly thus either engages the locking lever notch and pivots the locking lever against the interior surface of the reservoir wall or is placed against the locking lever notch of the rigidly attached locking lever, or is pushed against the locking arms into the opening so as to secure the tube assembly against the rigid wall of the reservoir and within the opening of the reservoir wall to create a substantially fluid tight seal between the tube assembly and the opening of the reservoir.

32 Claims, 4 Drawing Sheets

SYSTEM FOR SECURING TUBING

BACKGROUND OF THE INVENTION

1. Field of the Invention

The present invention relates generally to a system for securing tubing. In particular, the system for securing tubing is preferably for a printer cartridge having a reservoir, a rigid restraining member for a tube, and at least one locking lever.

2. Description of the Related Art

Systems for securing tubing have multiple uses such as, for example, in pneumatic systems using pressurized air in vehicle brakes and in air conditioners. Systems for securing tubing are also useful in hydraulic/fluid delivery systems such as printer cartridges. For both the pneumatic and hydraulic/fluid delivery systems, one important aspect of securing the tubing is seal integrity.

To this end, the prior art has generally used molded plastic components with either a "male" fitting integrated into the tubing securing system, or a separate fitting assembled to such a system. In either system, the seal is created by slipping an elastomeric tubing over the fitting. The fitting, which is usually beveled, easily allows the tube's inner diameter to slip over the fitting's outer diameter. The fitting's outer diameter may increase in diameter or have ridges which stretch the tube, thereby increasing the tube's inner diameter and creating a sealing force against the outer diameter of the fitting.

Numerous seal integrity problems may occur with such a system for securing tubing. One problem present in pressurized systems under moderate environmental conditions is the failure of the seal integrity over a period of time. This problem is especially prevalent in pneumatic systems. Another problem with the above described tubing securing system is that the tubing can be accidentally removed or knocked off during machine service. In addition to these functional problems, manufacturing problems may occur if this approach is used with small tubing, such as with tubes having a 3 mm outer diameter or less, due to the geometric detail required.

Molding the male fitting presents another manufacturing problem. In manufacturing the fitting, the parting line of the fitting that runs axially to the part must be completely eliminated or it will provide a leak path.

Consequently, it would be advantageous for a tubing securing system to maintain seal integrity in pressurized systems and in systems subject to moderate environmental conditions. Such a system would preferably eliminate the fitting parting line. Accordingly, it is to the provision of such a system that the present invention is primarily directed.

SUMMARY OF THE INVENTION

The present invention relates to a system for securing tubing which includes a reservoir having a rigid wall with interior and exterior surfaces, at least one locking lever with top and bottom ends, whereby at least one notch is proximate to the top end and the locking lever is pivotably attached by the bottom end to the interior surface of the reservoir wall, and a rigid restraining member for a tube, the restraining member having a passage therethrough. Alternately, the locking lever is rigidly attached to the interior surface of the reservoir and the restraining member can be attached to either the locking lever or the reservoir itself. Further, the reservoir wall has an opening into which the rigid restraining member fits when the tube is in fluid-tight connection with the restraining member to create a tube assembly. The tube assembly engages the locking lever notch and either the locking lever is pivotable against the interior surface of the reservoir wall or the placement of the tube assembly against the notch of the rigidly attached locking lever secures the restraining member against the rigid wall of the reservoir with the at least one locking lever notch.

In another embodiment, the restraining member is attached to the interior of the reservoir wall through at least two locking arms. The locking arms are pivotably attached to the restraining member and the interior of the reservoir wall such that the flexible tube can be slid onto the restraining member to form a tubing assembly, and then the tubing assembly is placed within the opening of the reservoir wall. Once placed within the opening, the tubing assembly is held in place by the locking action of the locking arms The present invention is also directed to a method of securing a flexible tube to a reservoir having a rigid wall with interior and an exterior surfaces, by way of a rigid restraining member for a tube, and the restraining member having a passage therethrough at least one locking lever with top and bottom ends, whereby at least one notch is proximate to the top end of the locking lever and the locking lever is pivotably attached by the bottom end to the interior surface of the reservoir wall. Moreover, the reservoir wall has an opening into which the rigid restraining member fits. The method preferably includes the steps of: (a) feeding a flexible tube into the at least one opening within the reservoir wall; (b) creating a fluid-tight connection with the flexible tube and the restraining member to create a tube assembly; (c) fitting the tube assembly within the at least one opening in the reservoir wall such that the tube assembly engages the at least one locking lever; and (d) pivoting the at least one locking lever against the interior surface of the reservoir so as to secure the restraining member against the rigid wall of the reservoir with the at least one locking lever notch to thereby secure the tube assembly within the opening.

Advantages of the invention will be obvious from the description, or may be learned by practice of the invention. Additional advantages of the invention will be realized and attained by means of the elements and combinations particularly pointed out in the appended claims. It is to be understood that both the foregoing general description and the following detailed description are exemplary and explanatory only and are not restrictive of the invention, as claimed.

The accompanying drawings, which are incorporated in and constitute a part of this specification, illustrate a preferred and alternate embodiments of the invention and together with the description, serve to explain the principles of the invention.

DETAILED DESCRIPTION OF THE INVENTION

The present invention may be understood more readily by reference to the following Figures and their previous and following description. Before the present systems and methods are disclosed and described, it is to be understood that the terminology used herein is for the purpose of describing particular embodiments only and is not intended to be limiting.

Figure 1:
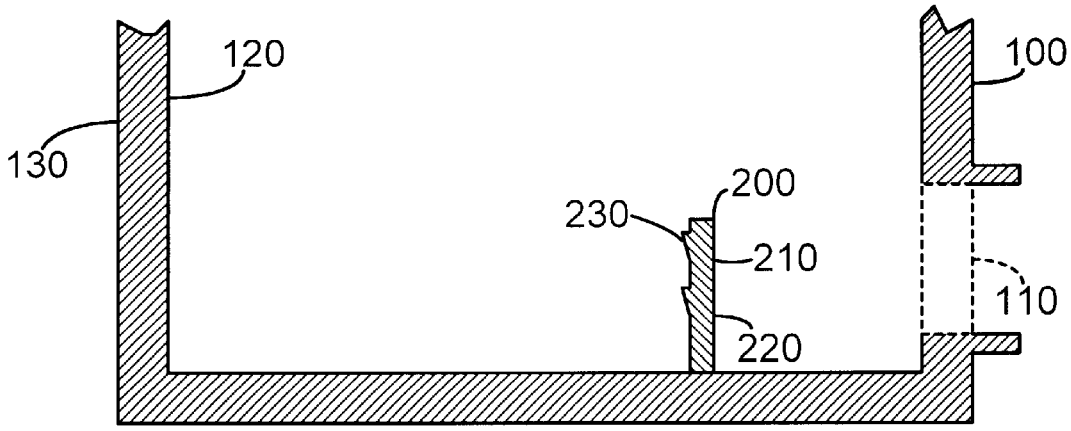
FIG. 1 is a cross-sectional view depicting a preferred embodiment of the reservoir and locking lever of the present invention.

Referring now to the drawings in which like numerals represent like components throughout the several views, FIG. 1 illustrates a preferred embodiment of a reservoir 100 with interior wall surface 120 and exterior wall surface 130. At least one opening 110 in the reservoir penetrates the interior wall surface 120 and exterior wall surface 130. The opening(s) may be any shape to facilitate creating a fluid-tight connection with the tube assembly 400, depicted in FIG. 3. In a preferred embodiment, the opening 110 is circular in shape.

Although the interior wall surface 120 and/or the exterior wall surface 130 can be comprised of a semi-flexible material, the reservoir wall is preferably a rigid material. Any suitable rigid material may be used, such as a molded plastic. In a preferred embodiment, the reservoir 100 is a printer cartridge.

FIG. 1 also depicts a preferred embodiment of the locking lever 200 with a top end 210 and a bottom end 220. Proximate to the top end of the locking lever 210 is at least one locking lever notch 230. Although FIG. 1 illustrates the locking lever 200 with two notches the locking lever may have only one notch 230 or more than two notches. Alternatively, the locking lever 200 may have more than two notches 230. Additionally, the system for securing tubing may include more than one locking lever 200. Further, the locking lever 200 can be either integral with or separately made and attached to the interior surface 120 of the reservoir. If the locking lever 200 is attached to the interior surface 120, such attachment must be sufficient whereby the locking lever 200 can both pivot and remain immovable from the interior surface 120 to secure the tubing assembly 400, as is further discussed herein.

The bottom end of the locking lever 220 is pivotably attached to the interior wall surface 120 of the reservoir 100. The locking lever 200 can be constructed of any suitable material known in the art, and is preferably constructed of a rigid material that allows pivoting movement.

Figure 2:
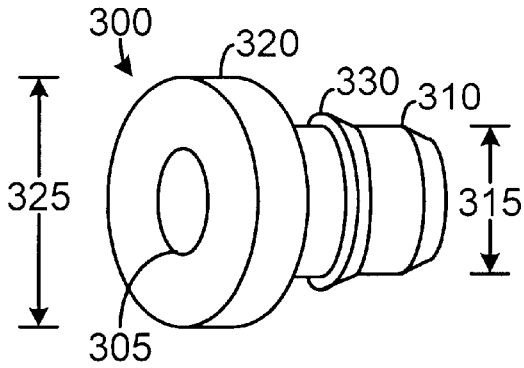
FIG. 2 is a perspective view depicting a preferred embodiment of the restraining member.

The restraining member is depicted in FIG. 2 in its preferred embodiment. The rigid restraining member 300 is a plug having a passage 305 therethrough with a first section 310 and a second section 320. In one preferred embodiment, the first section 310 has at least one ridge 330. Although the preferred embodiment shown in FIG. 2 has one ridge 330, the plug 300 may have two or more ridges. Placement of the ridge(s) 330 is not critical to the invention, and as such, the ridge(s) 330 may be placed anywhere within the first section 310 of the plug to effect a fluid-tight connection with the flexible tubing 500 as is particularly shown in FIG. 4.

Figure 4:
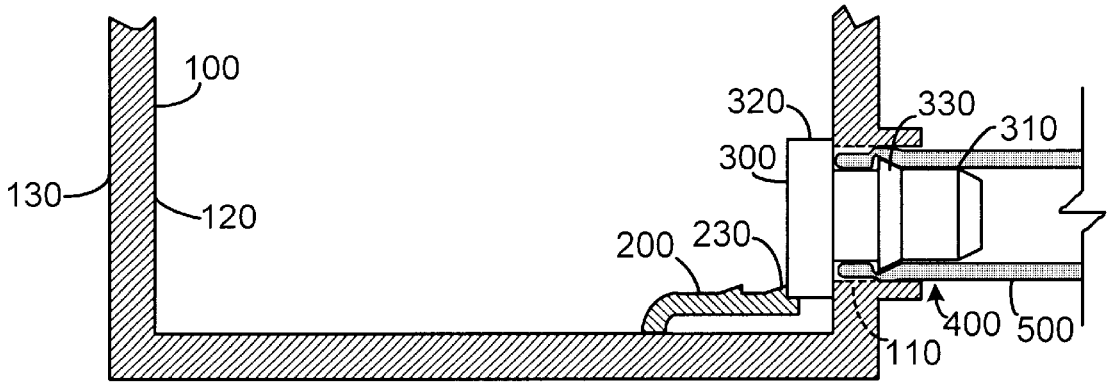
FIG. 4 is a partial cross-sectional view of the printer cartridge and tubing of a fully assembled system for securing tubing of the present invention.

Another preferred embodiment of the restraining member 300 has a first section 310 adjacent to a second section 320 and the first section 310 has a smaller diameter 315 than the diameter 325 of the second section 320. Alternatively, the second section 320 can not be circular, and can have alternate shapes that either fully or partially rest against the inner wall surfaces 120 of the reservoir 100, as shown in FIG. 4.

The restraining member 300 is made of any rigid material suitable to effect a fluid-tight connection with the flexible tubing 500 and for otherwise performing the functions set forth herein. Additionally, the restraining member 300 may be of any shape to effect a fluid-tight connection with the flexible tubing 500. In a preferred embodiment, the restraining member 300 has a first section 310 and a second section 320 and the first section 310 is cylindrical in shape, however, other shapes through the length of the plug can be alternately used.

The restraining member 300 fits within the reservoir opening(s) 110. In fact , the tube assembly 400 fits within the reservoir opening(s) 110. As shown in the partially assembled preferred embodiment of FIG. 3, the tube assembly 400 engages the locking lever(s) 200 when the tube assembly is inserted into the reservoir opening(s) 110. This causes the locking lever(s) 200 to pivot against the reservoir's interior surface 120 as illustrated in FIG. 4, which is an illustration of a fully assembled preferred embodiment for the system of securing tubing.

Figure 3:
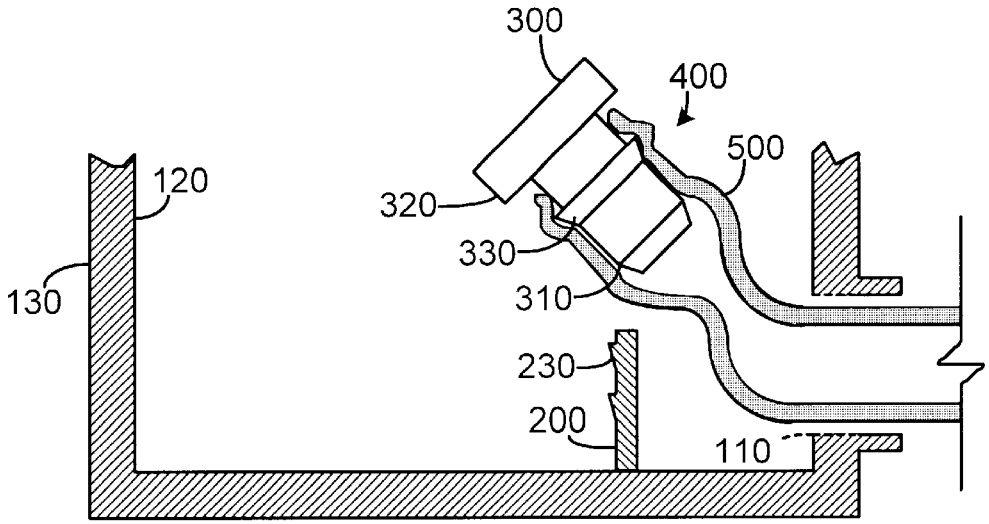
FIG. 3 is a partial cross-sectional view of a partially assembled system for securing tubing of the present invention.

As shown in FIG. 3 a flexible tube 500 is slid through the opening 110 and about the first section 310 of the restraining member 300 and over ridge 330 to preferably form a substantially fluid tight seal between the restraining member 300 and the flexible tube 500. The flexible tube 500 stretches about ridge 330 and is held onto the first section 310 of the restraining member 300 to create a tube assembly 400.

The restraining member 300 is secured against the reservoir interior surface 120 with the locking lever notch(es) 230. In a preferred embodiment, the second section 320 of the restraining member 300 fits within the notch 230 when the plug is secured against the reservoir interior surface 120, as illustrated in FIG. 4.

To secure the flexible tubing 500 to the reservoir 100 as shown in the preferred embodiment of FIG. 4, the flexible tubing 500 is fed into the opening(s) 110. The flexible tubing 500 is connected to the restraining member 300 to create a tube assembly 400 having a fluid-tight connection. In the preferred embodiment shown in FIG. 4, the tube assembly 400 is maneuvered such that the second section 320 is placed against the notch 230 of the locking lever 200 and then the tube assembly 400 is fitted into the opening(s) 110 of the reservoir 100 and engages the locking lever 200. The locking lever 200 pivots against the interior surface 120 of the reservoir 100 and then the restraining member 300 is secured against the interior surface 120 of with the locking lever notch 230 securing the tubing assembly 400 against the interior surface 120. The flexible tube 500 deforms within the opening 110 and is tightly held between the opening 110 in the reservoir 100 to thus create a substantially fluid tight seal between the locked tubing assembly 400 and the reservoir 100 wall, such seal maintained either by the second section 320 being firmly held against the interior surface 120 or by the flexible tube 500 expanding between the ridge 330 or the first section 310 and the opening 110 such that fluid can pass around the outside of the restraining member 300.

Figure 5:
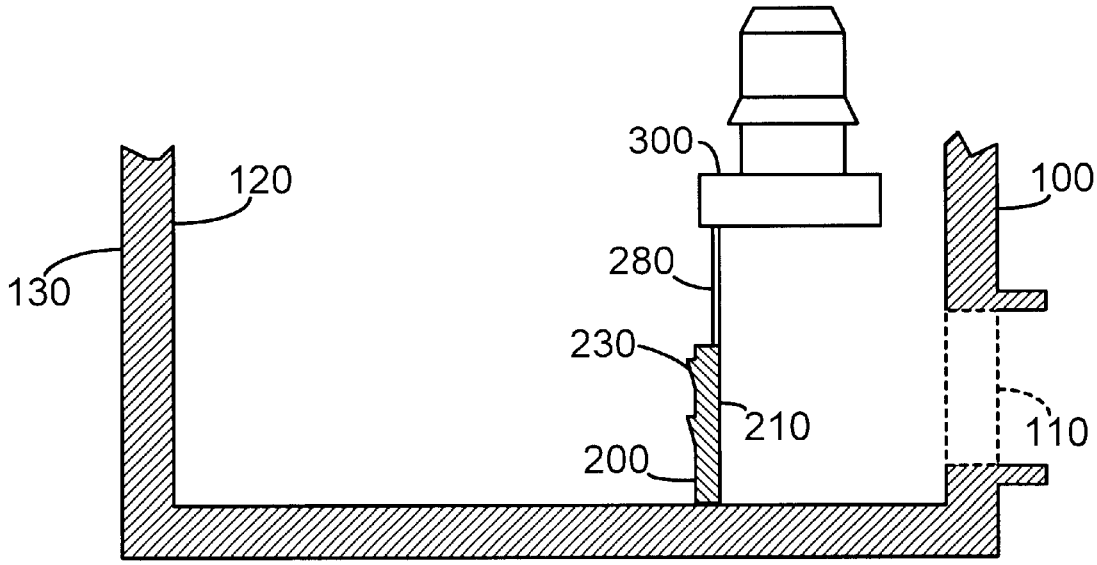
FIG. 5 is a partial cross-sectional view of a first alternate embodiment of the present invention illustrating the plug attached to the locking lever.

With reference to FIG. 5, a first alternate embodiment of the invention is illustrated with the plug 300 attached by attaching member 280 to the top end 210 of the locking lever 200. In use, the attachment member 280 can be broken such that the plug 300 and flexible tube 500 are fitted within the reservoir 100 wall as shown in FIGS. 3 and 4, or the attachment member 280 can remain connected to the plug 300 and the top end 210 of the locking lever 200 and the plug 300 can be bent around to receive the flexible tube 500 and lock into the opening 110 of the reservoir 100 wall. When the plug 300 remains attached to the attaching member 280, the attaching member 280 is constructed of a semi-rigid or flexible material such that it will minimally interfere with the placement of the locked tubing assembly 400 within the opening 110.

Figure 6:
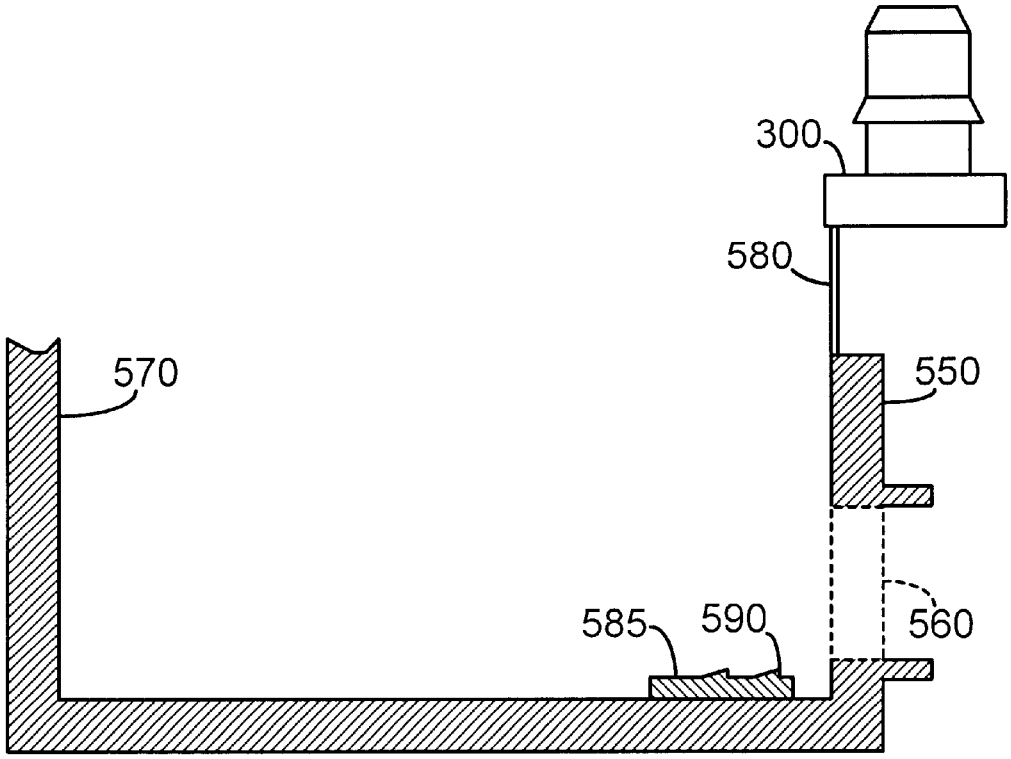
FIG. 6 is a partial cross-sectional view of a second alternate embodiment of the present invention illustrating the plug attached to the reservoir and a non-pivoting locking lever rigidly attached to the interior surface of the reservoir.

FIG. 6 illustrates a second alternate embodiment of the present invention having the plug 330 attached by attachment member 580 to the reservoir 550. The plug 300 can either remain attached to the reservoir 550 or detached therefrom prior to receiving the flexible tube 500 and being placed into opening 560. The locking lever 585 is shown as non-pivoting and rigidly attached to the interior surface 570 of the reservoir 550 such that one or more notches 590 rests in a locking position for the plug 300 relative to the opening 560. The plug 300 thus can have the flexible tube placed upon it to form the locked tubing assembly 400 and then the locked tubing assembly 400 can be placed into the opening 560 such that the locked tubing assembly 400 is locked into place due to placement against notch 590. Once held in place within the opening 560 by the notch 590 of the locking lever 585, the locking tubing assembly 400 will make a substantially fluid-tight fit between itself and the opening 560 in the reservoir 550.

Figure 7:
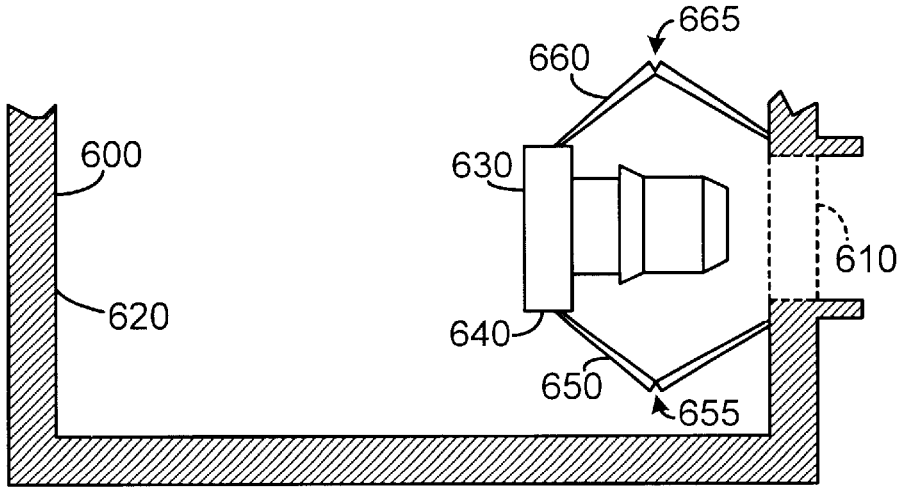
FIG. 7 is a partial cross-sectional view a third alternate embodiment of the present invention illustrating the plug attached by at least two locking arms to the interior surface of the reservoir such that the plug is held adjacent to the opening.

With reference to FIG. 7, a third alternate embodiment of the present invention is illustrated with the plug 630 attached by at least two locking arms 650,660 to the interior surface 620 of the reservoir 600 such that the plug 630 is held adjacent to the opening 610. The locking arms 650,660 can be made from any rigid or semi-rigid material, such as plastic, and can be the same material the reservoir 600 is constructed of. The locking arms 650,660 are attached to the second section 640 of the plug 630 and are pivotable or bend at joints 655,665 such that the plug 630 can be placed within the opening 610. Accordingly, as shown in FIG. 8, a flexible tube 500 is placed through the opening and about the plug 630 and then the tubing assembly 670 is placed within the opening 610 and locked into place.

Figure 8:
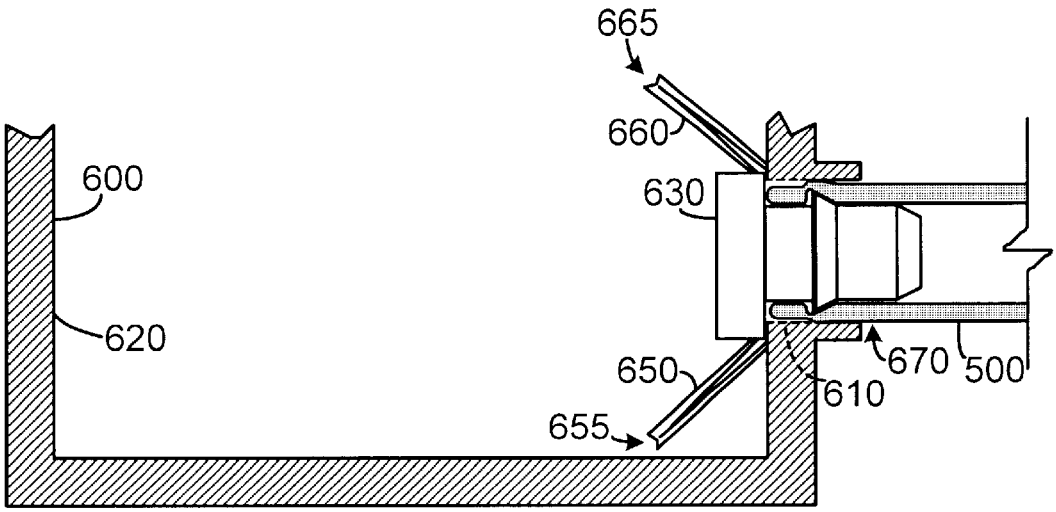
FIG. 8 is a partial cross-sectional view of the third alternate embodiment of the plug illustrating the tubing assembly secured within the opening of the reservoir by locked locking arms.

FIG. 8 particularly illustrates the third embodiment of the invention with the tubing assembly 670 secured within the opening 610 of the reservoir 600 from the locking action of the locking arms 650,660. When the tubing assembly 630 is placed into the opening 610, the locking arms 650,660 bend at joints 655,665 such that the locking arms 650,660 are doubled in half and restrain the tubing assembly 670 from backing out of the opening 610, thus making a substantially fluid tight seal between the tubing assembly 670 and the opening 610. Other configurations and designs for the locking arms 650,660 as are known in the art can be alternately used instead of joints 655,665 to lock the tubing assembly 670 into place.

While there has been shown a preferred and alternate embodiments of the present invention, it is to be understood that certain changes may be made in the forms and arrangements of the components and steps of the invention system and method without departing from the spirit and scope of the invention as set forth in the Claims appended herewith. In addition, the corresponding structures, materials, and equivalents of all means-plus-function elements in the claims are intended to include any structure, material, or component as known to one of skill in the art for performing the function in combination with the other claimed elements.

What is claimed is:

1. A system for securing tubing comprising:

(a) a reservoir having a rigid wall and at least one opening within the wall, wherein the wall has an interior surface and an exterior surface;

(b) at least one locking lever having a top end, a bottom end, and at least one notch proximate to the top end, wherein the bottom end of the locking lever is pivotably attached to the interior surface of the reservoir wall; and (c) a rigid restraining member for a tube having a passage therethrough, wherein the restraining member is fittable within the at least one opening in the reservoir wall, wherein a flexible tube is slid through the at least one opening in the reservoir wall and maneuvered in fluid-tight connection with the restraining member to create a tube assembly and the tube assembly is fitted within the at least one opening in the reservoir wall such that the tube assembly engages the at least one locking lever and the locking lever is pivotable against the interior surface of the reservoir wall so as to secure the restraining member against the rigid wall of the reservoir with the at least one locking lever notch.

2. The system of claim 1, wherein the reservoir is a print cartridge.

3. The system of claim 1, wherein the restraining member is attached to the top end of the locking lever.

4. The system of claim 1, wherein the at least one locking lever is comprised of a rigid material.

5. The system of claim 1, wherein the restraining member is a plug with a first section and a second section and the first section of the plug has at least one ridge for securing a flexible tube fitted thereabout.

6. The system of claim 5, wherein the second section of the plug has an extended portion such that at least part of the extended portion is fittable within the at least one locking lever notch when the plug is secured against the rigid wall of the reservoir.

7. The system of claim 1, wherein the restraining member is a plug with a first section adjacent to a second section, wherein the first section has a cross-sectional area that is smaller in diameter than the diameter of the second section.

8. The system of claim 1, wherein the tube assembly is in fluid-tight connection with the at least one opening in the reservoir wall.

9. A method of securing a flexible tube to a reservoir having a rigid wall and at least one opening within the wall, wherein the wall has an interior surface and an exterior surface, with a rigid restraining member for a tube having a passage therethrough wherein the restraining member is fittable within the at least one opening in the reservoir wall, using at least one locking lever having a top end, a bottom end, and at least one notch proximate to the top end, and wherein the bottom end of the locking lever is pivotably attached to the interior surface of the reservoir wall, the method comprising the steps of:

(a) feeding a flexible tube into the at least one opening within the reservoir wall;

(b) creating a fluid-tight connection with the flexible tube and the restraining member to create a tube assembly;

(c) fitting the tube assembly within the at least one opening in the reservoir wall such that the tube assembly engages the at least one locking lever; and (d) pivoting the at least one locking lever against the interior surface of the reservoir so as to secure the restraining member against the rigid wall of the reservoir with the at least one locking lever notch to thereby secure the tube assembly.

10. The method of claim 9, wherein the reservoir is a print cartridge.

11. The method of claim 9, wherein the at least one opening in the reservoir wall is a circular opening.

12. The method of claim 9, wherein the at least one locking lever is comprised of a rigid material.

13. The method of claim 9, wherein the restraining member is a plug with a first section and a second section and the first section of the plug has at least one ridge for securing a flexible tube fitted thereabout.

14. The method of claim 13, wherein the second section of the plug has an extended portion such that at least part of the extended portion is fittable within the at least one locking lever notch when the plug is secured against the rigid wall of the reservoir.

15. The method of claim 9, wherein the restraining member is a plug with a first section adjacent to a second section, wherein the first section has a cross-sectional area that increases in area up to the second section.

16. The method of claim 9, wherein the tube assembly is in fluid-tight connection with the at least one opening in the reservoir wall.

17. A system for securing tubing comprising:

(a) a fluid containing means for containing a fluid wherein the fluid containing means has a rigid wall and at least one opening within the wall, wherein the wall has an interior surface and an exterior surface;

(b) a locking means for locking a restraining means wherein the locking means has a top end, a bottom end, and at least one notch proximate to the top end, wherein the bottom end of the locking means is pivotably attached to the interior surface of the wall of the fluid containing means; and (c) a restraining means for restraining a tube wherein the restraining means has a passage therethrough and is fittable within the at least one opening in the wall of the fluid containing means, wherein a flexible tube is slid through the at least one opening in the wall of the fluid containing means and the tube is maneuvered in fluid-tight connection with the restraining means to create a tube assembly and the tube assembly is fitted within the at least one opening in the wall of the fluid containing means such that the tube assembly engages the locking means and the locking means is pivotable against the interior surface of the wall of the fluid containing means so as to secure the restraining means against the rigid wall of the fluid containing means with the at least one locking means notch.

18. The system of claim 17, wherein the fluid containing means is a print cartridge.

19. The system of claim 17, wherein the at least one opening in the wall of the fluid containing means is a circular opening.

20. The system of claim 17, wherein the locking means is comprised of a rigid material.

21. A system for securing tubing comprising:

(a) a reservoir having a rigid wall and at least one opening within the wall, wherein the wall has an interior surface and an exterior surface;

(b) at least one locking lever having at least one notch, the locking lever rigidly attached to the interior surface of the reservoir; and (c) a rigid restraining member for a tube having a passage therethrough, wherein the restraining member is fittable within the at least one opening in the reservoir wall, wherein a flexible tube is slid through the at least one opening in the reservoir wall and maneuvered in fluid-tight connection with the restraining member to create a tube assembly and the tube assembly is fitted within the at least one opening in the reservoir wall such that the tube assembly engages the at least one locking lever notch so as to secure the restraining member against the rigid wall of the reservoir.

22. The system of claim 21, wherein the reservoir is a print cartridge.

23. The system of claim 21, wherein the restraining member is attached to the reservoir.

24. The system of claim 21, wherein the at least one locking lever is comprised of a rigid material.

25. The system of claim 21, wherein the restraining member is a plug with a first section and a second section and the first section of the plug has at least one ridge for securing a flexible tube fitted thereabout.

26. The system of claim 25, wherein the second section of the plug has an extended portion such that at least part of the extended portion is fittable within the at least one locking lever notch when the plug is secured against the rigid wall of the reservoir.

27. A system for securing tubing comprising:

(a) a reservoir having a rigid wall and at least one opening within the wall, wherein the wall has an interior surface and an exterior surface;

(b) a rigid restraining member for a tube having a passage therethrough, wherein the restraining member is fittable within the at least one opening in the reservoir wall;

(c) at least two locking arms, each locking arm pivotably attached to the restraining member and the interior surface of the reservoir wall; and wherein a flexible tube is slid through the at least one opening in the reservoir wall and maneuvered in fluid-tight connection with the restraining member to create a tube assembly, and the tube assembly is fitted within the at least one opening in the reservoir wall such that the locking arms secure the restraining member against the rigid wall and within the opening of the reservoir.

28. The system of claim 27, wherein the reservoir is a print cartridge.

29. The system of claim 27, wherein the at least two locking arms are comprised of a rigid material.

30. The system of claim 27, wherein the restraining member is a plug with a first section and a second section and the first section of the plug has at least one ridge for securing a flexible tube fitted thereabout.

31. The system of claim 30, wherein the second section of the plug has an extended portion each locking arm is attached to the second section of the plug.

32. The system of claim 27, wherein the locking arms hold the tube assembly in fluid-tight connection with the at least one opening in the reservoir wall.

* * * * *